US008476994B2

(12) United States Patent
Kim et al.

(10) Patent No.: US 8,476,994 B2
(45) Date of Patent: Jul. 2, 2013

(54) ELECTROMECHANICAL SWITCH AND METHOD OF MANUFACTURING THE SAME

(75) Inventors: Dong-chul Kim, Suwon-si (KR); Ran-ju Jung, Suwon-si (KR); Sun-ae Seo, Hwaseong-si (KR); Chang-won Lee, Seoul (KR); Hyun-jong Chung, Hwaseong-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 170 days.

(21) Appl. No.: 11/980,456

(22) Filed: Oct. 31, 2007

(65) Prior Publication Data

US 2009/0020399 A1 Jan. 22, 2009

(30) Foreign Application Priority Data

Jul. 19, 2007 (KR) ..... 10-2007-0072485

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS

| | | | | |
|---|---|---|---|---|
| 5,638,946 | A * | 6/1997 | Zavracky | 200/181 |
| 6,153,839 | A * | 11/2000 | Zavracky et al. | 200/181 |
| 7,405,854 | B2 * | 7/2008 | Desai et al. | 359/224.1 |
| 2004/0075514 | A1 * | 4/2004 | Ono et al. | 335/78 |
| 2008/0220282 | A1 * | 9/2008 | Jang et al. | 428/689 |
| 2008/0268318 | A1 * | 10/2008 | Jang et al. | 429/34 |
| 2008/0312368 | A1 * | 12/2008 | Prud'homme et al. | 524/424 |
| 2009/0159410 | A1 * | 6/2009 | Wang et al. | 200/181 |
| 2009/0305135 | A1 * | 12/2009 | Shi et al. | 429/217 |
| 2010/0188796 | A1 * | 7/2010 | Bulovic et al. | 361/280 |
| 2010/0330687 | A1 * | 12/2010 | Afzali-Ardakani et al. | 436/149 |

FOREIGN PATENT DOCUMENTS

KR 20030022705 A 3/2003

OTHER PUBLICATIONS

Korean Office Action dated Jan. 25, 2013 for corresponding Korean Application No. 10-2007-0072485 (full translation provided).

* cited by examiner

*Primary Examiner* — Bernard Rojas
(74) *Attorney, Agent, or Firm* — Harness, Dickey & Pierce, P.L.C.

(57) ABSTRACT

Provided is an electromechanical switch and a method of manufacturing the same. The electromechanical switch includes an elastic conductive layer that moves by the application of an electric field, wherein the elastic conductive layer includes at least one layer of graphene.

21 Claims, 4 Drawing Sheets

ELECTROMECHANICAL SWITCH AND METHOD OF MANUFACTURING THE SAME

CROSS-REFERENCE TO RELATED PATENT APPLICATION

This application claims the benefit of Korean Patent Application No. 10-2007-0072485, filed on Jul. 19, 2007, in the Korean Intellectual Property Office, the disclosure of which is incorporated herein in its entirety by reference.

BACKGROUND OF THE INVENTION

1. Field of the Invention

The present invention relates to an electromechanical system and a method of manufacturing the same, and more particularly, to an electromechanical switch and a method of manufacturing the same.

2. Description of the Related Art

Nano-electromechanical systems (NEMSs) use electrical signals generated by mechanical movement after transforming external electrical signals into mechanical movement.

In order to form NEMSs, a material having good electromechanical characteristics must be used. A material that shows good electromechanical characteristics on a nano size scale is a carbon nanotube (CNT). CNTs have advantages of having small atomic mass and a large Young's modulus (0.5 to 1 TPa).

However, due to problems related to methods of manufacturing CNTs, CNTs cannot easily be applied to NEMSs.

More specifically, according to a conventional method of manufacturing CNTs, a large number of cylindrical CNTs can be formed in one cycle process. However, cylindrical CNTs do not have uniform characteristics and reproducibility. Also, generally, CNTs formed on a first substrate must be moved to a second substrate to form a NEMS. However, it is difficult to correctly arrange nano-sized CNTs on predetermined locations of the second substrate. Also, high power is required to transform cylindrical CNTs having a diameter of a few to a few tens of nano meters. Additionally, when the CNTs are exposed to air, the CNTs are liable to react with various foreign materials, and thus, the characteristics of the CNTs are easily degraded. For this reason, the production of NEMSs that use CNTs is practically very difficult.

SUMMARY OF THE INVENTION

To address the above and/or other problems, the present invention provides an electromechanical switch that can be easily manufactured, has low power consumption, and can stably maintain its characteristics.

The present invention also provides a method of manufacturing the electromechanical switch.

According to an aspect of the present invention, there is provided an electromechanical switch comprising an elastic conductive layer that moves by the application of an electric field, wherein the elastic conductive layer comprises at least one layer of graphene.

The elastic conductive layer may comprise 1 to 500 layers of graphene.

The electromechanical switch may comprise: a substrate, a source electrode, a gate electrode, and a drain electrode, all of which are formed on the substrate and separated from each other; and the elastic conductive layer that contacts the source electrode and is separated from the gate electrode and the drain electrode, wherein a first end of the elastic conductive layer contacts the source electrode, a second end of the elastic conductive layer is located above the drain electrode, and the gate electrode is formed between the first and second ends of the elastic conductive layer.

The electromechanical switch may further comprise a supporter between the substrate and the source electrode.

The elastic conductive layer may be formed between the supporter and the source electrode.

The supporter, the gate electrode, and the drain electrode may be sequentially arranged in a row on the substrate.

The supporter may have a height of 5 to 500 nm.

The distance between the supporter and the gate electrode may be 50 to 2950 nm.

The distance between the supporter and the drain electrode may be 100 to 3000 nm.

The elastic conductive layer may have a width of 10 to 200 nm.

According to another aspect of the present invention, there is provided a method of manufacturing an electromechanical switch comprising: forming a gate electrode and a drain electrode on a base substrate, wherein the gate electrode and drain electrode; forming an elastic conductive layer having a line shape, a first end of which is supported by the base substrate, the rest of which is separated from the gate electrode and the drain electrode, and that comprises at least one layer of graphene; and forming a source electrode on the base substrate, covering the first end of the elastic conductive layer.

The elastic conductive layer may comprise 1 to 500 layers of graphene.

The base substrate may comprise: a substrate on which the gate electrode and the drain electrode are formed; and a supporter that is formed on the substrate and by which one end of the elastic conductive layer is supported.

The supporter, the gate electrode, and the drain electrode may be sequentially arranged in a row on the substrate.

The forming of the elastic conductive layer may comprise: forming a sacrifice supporting layer covering the gate electrode and the drain electrode on the substrate, such that the sacrifice supporting layer is formed to be adjacent to the supporter; forming an elastic conductive layer on the supporter and the sacrifice supporting layer; patterning the elastic conductive layer; and removing the sacrifice supporting layer.

The elastic conductive layer may be formed by using an exfoliation method.

The supporter may have a thickness of 5 to 500 nm.

The distance between the supporter and the gate electrode may be 50 to 2950 nm.

The distance between the supporter and the drain electrode may be 100 to 3000 nm.

The elastic conductive layer may have a width of 10 to 200 nm.

The sacrifice supporting layer may be formed of a resin.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
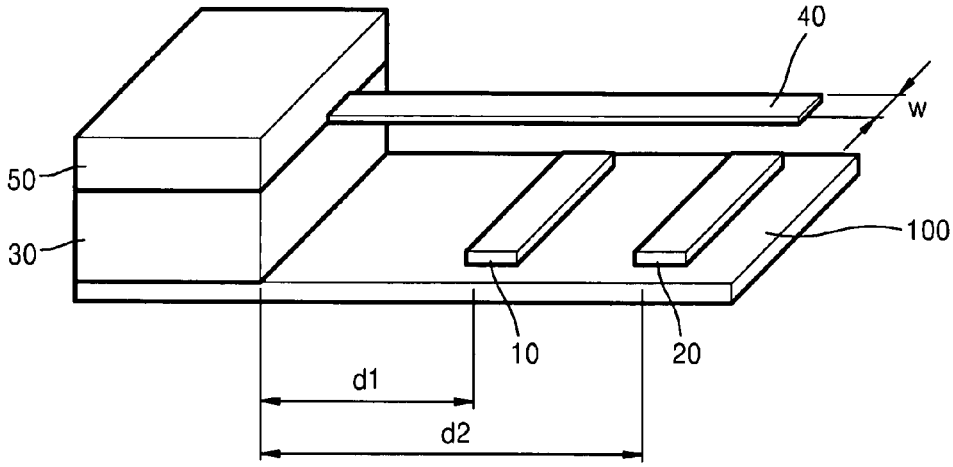
FIG. 1 is a perspective view of an electromechanical switch according to an embodiment of the present invention.

An electromechanical switch and a method of manufacturing the same according to the present invention will now be described more fully with reference to the accompanying drawings in which exemplary embodiments of the invention are shown. In the drawings, the thicknesses of layers and regions are exaggerated for clarity, and like reference numerals refer to the like elements.

FIG. 1 is a perspective view of an electromechanical switch according to an embodiment of the present invention.

Referring to FIG. 1, the electromechanical switch according to the current embodiment of the present invention includes a substrate 100, a gate electrode 10, a drain electrode 20, a supporter 30, an elastic conductive layer 40 and a source electrode 50. The gate electrode 10, the drain electrode 20 and the supporter 30 are formed on the substrate 100. The supporter 30, the gate electrode 10, and the drain electrode 20 can be sequentially arranged in a row. The gate electrode 10 and the drain electrode 20 may be bar type electrodes and can be formed to be parallel to each other. A distance d1 from the supporter 30 to the gate electrode 10 can be 50 to 2950 nm, and a distance d2 from the supporter 30 to the drain electrode 20 can be 100 to 3000 nm.

The gate electrode 10 has a thickness similar to that of the drain electrode 20, and the supporter 30 may have a thickness greater than that of the gate electrode 10 and the drain electrode 20. The supporter 30 can be an insulating material or a conductive material, and can have a thickness of 5 to 500 nm.

The elastic conductive layer 40 extends from an upper surface of the supporter 30 to be disposed above the gate electrode 10 and the drain electrode 20. The elastic conductive layer 40 can include 1 to 500 layers of graphene. The elastic conductive layer 40 may have a width w of 10 to 200 nm. The elastic conductive layer 40 may be formed in a lengthwise direction extending beyond the drain electrode 20. The graphene that constitutes the elastic conductive layer 40 will be described later.

The source electrode 50 covering the elastic conductive layer 40 is formed on the supporter 30. A first end of the elastic conductive layer 40 is disposed on the supporter 30, and a second end of the elastic conductive layer 40 is disposed above the drain electrode 20. The gate electrode 10 is formed on the substrate 100 between the first and second ends of the elastic conductive layer 40.

When a predetermined voltage is applied to the gate electrode 10 in the electromechanical switch having the above structure, an electric field is generated from the gate electrode 10. A Coulomb force is applied to the elastic conductive layer 40 due to the electric field, and thus, the elastic conductive layer 40 can bend downward. Accordingly, the second end of the elastic conductive layer 40 can contact the drain electrode 20. A state in which the elastic conductive layer 40 contacts the drain electrode 20 comprises an "ON' state of the electromechanical switch. When the voltage applied to the gate electrode 10 is removed, the elastic conductive layer 40 returns to its original state, and thus, the elastic conductive layer 40 and the drain electrode 20 are separated. A state in which the elastic conductive layer 40 is separated from the drain electrode 20 comprises an "OFF' state of the electromechanical switch.

The graphene that constitutes the elastic conductive layer 40 will now be described. Graphene is a single layer structure formed of carbon. Graphite is a three-dimensional crystal structure in which a large plurality of layers of graphene are stacked. Graphene has a small atomic mass and a large Young's modulus (0.5 to 1 TPa), and can be formed easier than carbon nanotubes (CNTs). More specifically, CNTs must be moved from a first substrate to a second substrate after being formed on the first substrate. However, graphene can be formed on a substrate for manufacturing a nano-electromechanical system (NEMS). After forming a plate type graphene, the graphene can be patterned to a desired shape for use, for example, a line shape. Thus, if a NEMS is formed using graphene, a misalignment problem due to movement of constituent elements between substrates does not occur. Also, it can be easy to control the shape of the elastic conductive layer 40, and thus, it is advantageous for maintaining device uniformity. Also, since graphene has a thin film shape, the graphene can be more easily bent by the application of an external electric field compared to cylindrical CNTs. Therefore, when graphene is used to form the elastic conductive layer 40, power consumption of the electromechanical switch according to the current embodiment of the present invention can be reduced. Additionally, graphene is more stable in the air than CNTs, and thus, the electromechanical switch according to the embodiment of the present invention has a better switching characteristic and a longer life span than a conventional switch that includes CNTs.

FIGS. 2A through 2G are perspective views illustrating a method of manufacturing an electromechanical switch, according to an embodiment of the present invention.

Figure 2A:
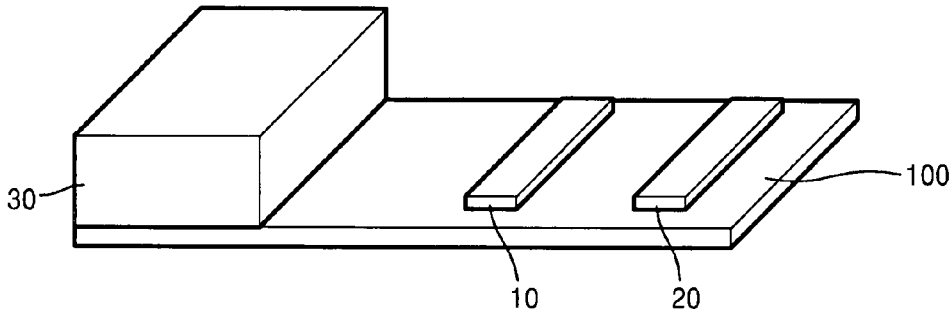
FIGS. 2A through 2G are perspective views illustrating a method of manufacturing an electromechanical switch, according to an embodiment of the present invention.

Referring to FIG. 2A, a gate electrode 10 and a drain electrode 20 separated a predetermined distance from each other are formed on an insulating substrate 100. The gate electrode 10 and the drain electrode 20 may be bar type electrodes and can be formed to be parallel to each other. The gate electrode 10 and the drain electrode 20 can be formed to have the same thickness using an identical material.

A supporter 30 is formed on a portion of the insulating substrate 100 and to a side of the gate electrode 10, such that the gate electrode 10 is disposed between the supporter 30 and the drain electrode 20, and the supporter 30, the gate electrode 10, and the drain electrode 20 can be arranged in a row. A distance between the supporter 30 and the gate electrode 10 can be 50 to 2950 nm, and a distance between the supporter 30 and the drain electrode 20 can be 100 to 3000 nm. The supporter 30 can be formed of an insulating material or a conductive material. The supporter 30 may have a thickness greater than that of the gate electrode 10 and the drain electrode 20. The supporter 30 can have a thickness of 5 to 500 nm.

Figure 2B:
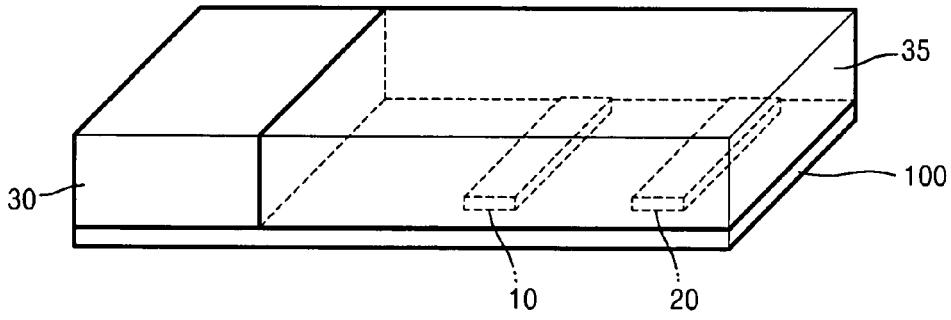

Referring to FIG. 2B, a sacrifice supporting layer 35 covering the gate electrode 10 and the drain electrode 20 is formed on the portion of the substrate 100 on which the supporter 30 is not formed. The sacrifice supporting layer 35 can be formed of a resin and may be formed to have the same thickness as the supporter 30. The sacrifice supporting layer 35 according to the current embodiment of the present invention is transparent; however, the present invention is not limited thereto.

Figure 2C:
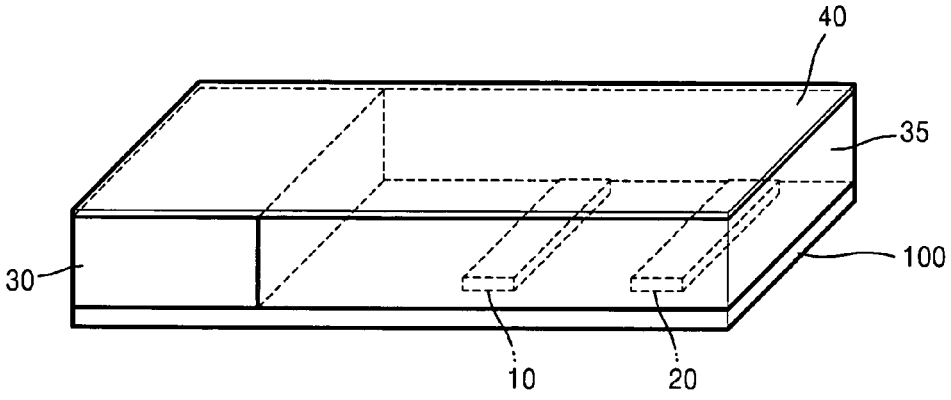

Referring to FIG. 2C, an elastic conductive layer 40 having a plate shape is formed on the supporter 30 and the sacrifice supporting layer 35. The elastic conductive layer 40 includes at least one layer of graphene. Preferably, the elastic conductive layer 40 is formed of 1 to 500 layers of graphene. The elastic conductive layer 40 can be formed by an exfoliation method using single crystal graphite. If the elastic conductive layer 40 is formed using the exfoliation method, Van der Waals' force is applied between upper surfaces of the supporter 30 and the sacrifice supporting layer 35 and the single crystal graphite, and a few to a few hundreds of layers of graphene can be formed on the upper surfaces of the supporter 30 and the sacrifice supporting layer 35. The method of forming the elastic conductive layer 40 is not limited to the exfoliation method.

Figure 2D:
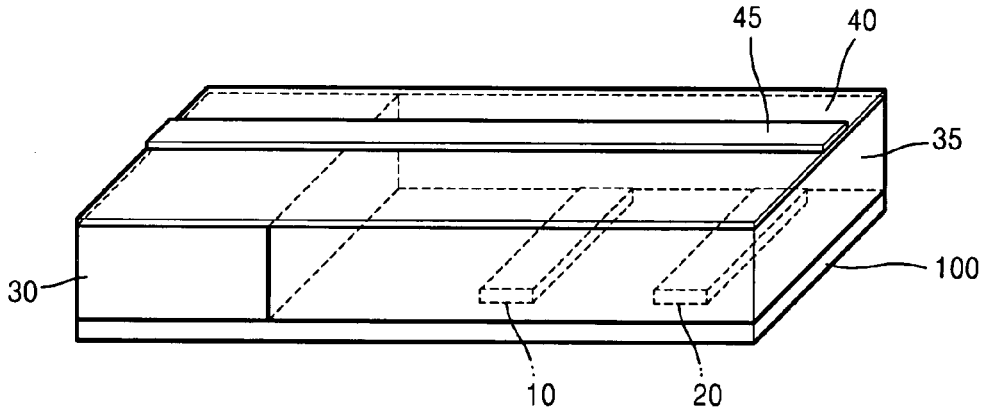

Referring to FIG. 2D, a resin layer pattern 45 is formed on the elastic conductive layer 40. The resin layer pattern 45 can be line-shaped, and a first end of the resin layer pattern 45 is disposed on the supporter 30 and a second end thereof is disposed above the drain electrode 20. The resin layer pattern 45 may be formed to be a little bit longer than the distance from the supporter 30 to the drain electrode 20. The resin layer pattern 45 can have a width of 10 to 200 nm, and can be formed of a photoresist material or an electron beam resist material, preferably formed of the same material as the sacrifice supporting layer 35.

Figure 2E:
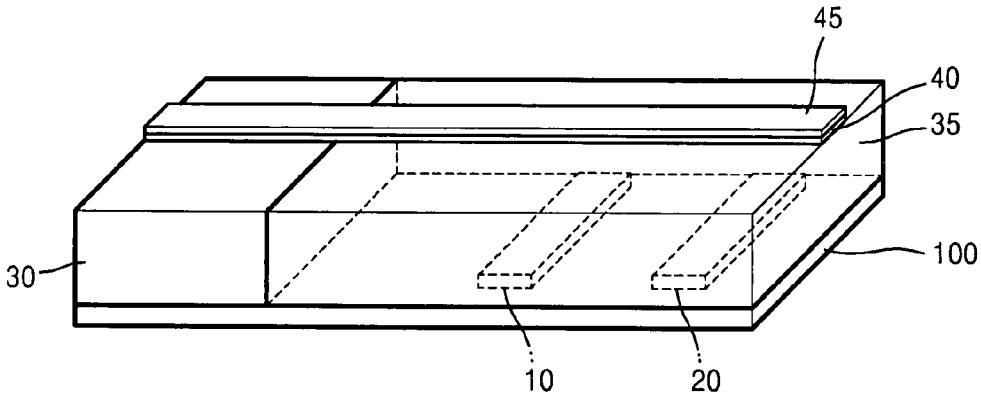

The elastic conductive layer 40 is etched using the resin layer pattern 45 as an etch mask. As a result of etching with respect to the elastic conductive layer 40, a structure as depicted in FIG. 2E is obtained.

Figure 2F:
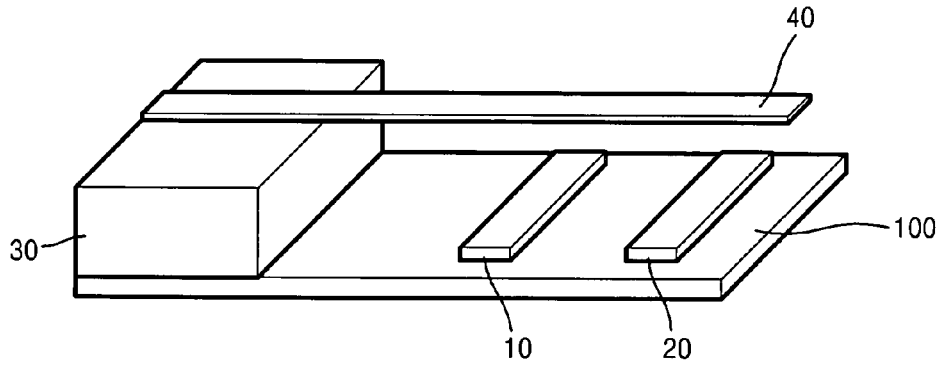

Next, the resin layer pattern 45 and the sacrifice supporting layer 35 are removed, thus obtaining a structure as depicted in FIG. 2F.

Figure 2G:
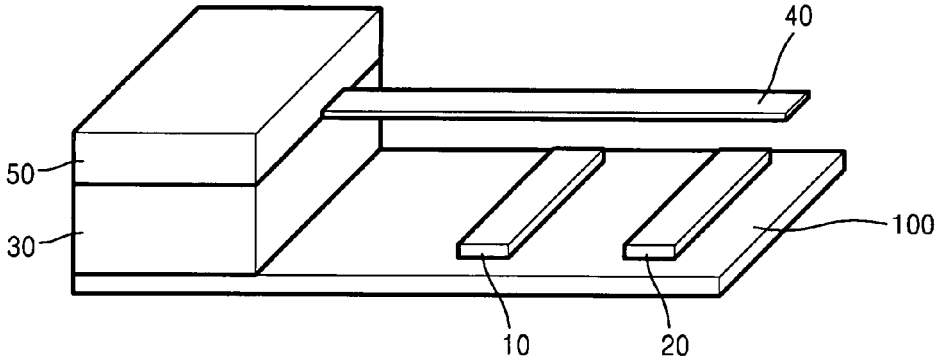

Referring to FIG. 2G, a source electrode 50 that contacts the elastic conductive layer 40 is formed on the supporter 30. The stage in the process at which the source electrode 50 is formed can vary. For example, the source electrode 50 can be formed after removing the portion of the resin layer pattern 45 formed on the portion of the elastic conductive layer 40 on the supporter 30. In this case, the sacrifice supporting layer 35 and the remaining portion of the resin layer pattern 45 are removed after the source electrode 50 is formed.

The electromechanical switch according to the present invention is formed using graphene that has good electromechanical characteristics and can be easily formed. Thus, the electromechanical switch according to the present invention can be easily manufactured and has high uniformity and reproducibility compared to a conventional switch formed using CNTs.

Also, the electromechanical switch according to the present invention has a long life span and good switching characteristics since graphene is more stable in air than CNTs.

Also, graphene can be easily bent by the application of an external electric field compared to cylindrical CNTs, and thus, the electromechanical switch according to the present invention has low power consumption.

While the present invention has been shown and described with reference to embodiments thereof, it should not be construed as being limited to such embodiments. Those of ordinary skill in this art know, for example, that the locations and shapes of the constituent elements in the electromechanical switch of FIG. 1 can vary, and accordingly, the method of manufacturing the electromechanical switch can also be varied. For example, in the structure of FIG. 1, it can be seen that the source electrode 50 can be directly formed on the substrate 100 without the supporter 30, and the supporter 30 and the substrate 100 can together constitute a single base substrate. Also, the electromechanical switch according to the present invention can be applied to not only NEMS systems but also micro-electromechanical systems. Therefore, the scope of the invention is not defined by the detailed description of the invention but by the appended claims.

What is claimed is:

1. An electromechanical switch comprising:

a substrate;

a supporter formed on a first region of the substrate;

a gate electrode and a drain electrode which are formed on a second region and third region of the substrate, respectively;

an elastic conductive layer formed on the supporter, a first end of which is supported by the supporter and a second end of which is separated from the gate electrode and the drain electrode, the elastic conductive layer being configured to move by the application of an electric field, the elastic conductive layer including at least one plate type graphene layer without a resin; and a source electrode formed on the supporter to cover the first end of the elastic conductive laver.

2. The electromechanical switch of claim 1, wherein the elastic conductive layer comprises 1 to 500 layers of graphene.

3. The electromechanical switch of claim 1, wherein the first end of the elastic conductive layer contacts the source electrode, the second end of the elastic conductive layer is disposed above the drain electrode, and the gate electrode is formed between the first and second ends of the elastic conductive layer.

4. The electromechanical switch of claim 1, wherein the supporter, the gate electrode, and the drain electrode are sequentially arranged in a row on the substrate.

5. The electromechanical switch of claim 4, wherein the distance between the supporter and the gate electrode is 50 to 2950 nm.

6. The electromechanical switch of claim 4, wherein the distance between the supporter and the drain electrode is 100 to 3000 nm.

7. The electromechanical switch of claim 1, wherein the supporter has a height of 5 to 500 nm.

8. The electromechanical switch of claim 3, wherein the elastic conductive layer has a width of 10 to 200 nm.

9. The electromechanical switch of claim 1, wherein the elastic conductive layer has a patterned thin film structure including the at least one plate type graphene layer.

10. A method of manufacturing an electromechanical switch, comprising:

providing a substrate;

forming a supporter on a first region of the substrate;

forming a gate electrode and a drain electrode on a second region and a third region of the substrate, respectively, wherein the gate electrode and drain electrode are separated from each other;

forming an elastic conductive layer having a line shape on the supporter, a first end of which is supported by the supporter, a second end of which is separated from the gate electrode and the drain electrode, and the elastic conductive layer comprises at least one plate type graphene layer without a resin; and forming a source electrode on the supporter, covering the first end of the elastic conductive layer.

11. The method of claim 10, wherein the elastic conductive layer is comprises 1 to 500 layers of graphene.

12. The method of claim 10, wherein the supporter, the gate electrode, and the drain electrode are sequentially arranged in a row on the substrate.

13. The method of claim 12, wherein the distance between the supporter and the gate electrode is 50 to 2950 nm.

14. The method of claim 12, wherein the distance between the supporter to the drain electrode is 100 to 3000 nm.

15. The method of claim 10, wherein the forming of the elastic conductive layer comprises:

forming a sacrifice supporting layer covering the gate electrode and the drain electrode on the substrate, such that the sacrifice supporting layer is formed to be adjacent to the supporter;

forming an elastic conductive layer on the supporter and the sacrifice supporting layer;

patterning the elastic conductive layer; and removing the sacrifice supporting layer.

16. The method of claim 15, wherein the elastic conductive layer is formed using an exfoliation method.

17. The method of claim 15, wherein the sacrifice supporting layer is formed of comprises a resin.

18. The method of claim 10, wherein the supporter has a thickness of 5 to 500 nm.

19. The method of claim 10, wherein the elastic conductive layer has a width of 10 to 200 nm.

20. The method of claim 10, wherein the elastic conductive layer is formed to have a patterned thin film structure including the at least one plate type graphene layer.

21. An electromechanical switch comprising:

an elastic conductive layer that moves by the application of an electric field, wherein the elastic conductive layer includes at least one plate type graphene layer without a resin; and a substrate below the elastic conductive layer, the substrate having an upper surface that is planar and faces the elastic conductive layer, wherein the elastic conductive layer has a bottom surface that is planar and faces the upper surface of the substrate, and wherein the elastic conductive layer has a uniform thickness.

* * * * *